US006796448B1

(12) United States Patent
Wilt et al.

(10) Patent No.: US 6,796,448 B1
(45) Date of Patent: Sep. 28, 2004

(54) RAILCAR DRAFT GEAR HOUSING

(75) Inventors: Donald E. Wilt, Batavia, IL (US); David G. Anderson, Chesterton, IN (US); Andrew W. Withall, St. Charles, IL (US)

(73) Assignee: Miner Enterprises, Inc., Geneva, IL (US)

( * ) Notice: Subject to any disclaimer, the term of this patent is extended or adjusted under 35 U.S.C. 154(b) by 0 days.

(21) Appl. No.: 10/379,028

(22) Filed: Mar. 4, 2003

(51) Int. Cl.[7] ..... B61G 11/00

(52) U.S. Cl. ..... 213/40 R; 213/7; 213/67 R; 213/50; 213/9

(58) Field of Search ..... 213/7, 9, 10, 22, 213/23, 26, 32 R, 40 R, 44, 45, 46 A, 47, 60, 64, 65, 66, 67 R, 68, 69, 50

(56) References Cited

U.S. PATENT DOCUMENTS

| | | | | |
|---|---|---|---|---|
| 2,880,884 A | * | 4/1959 | Dentler | 213/40 R |
| 3,370,718 A | * | 2/1968 | Waddell | 213/32 R |
| 4,296,868 A | | 10/1981 | Housman | |
| 4,591,059 A | * | 5/1986 | Hammarlund | 213/32 R |
| 5,139,579 A | | 8/1992 | Kovacs et al. | |
| 5,207,718 A | | 5/1993 | Glover et al. | |
| 5,361,917 A | | 11/1994 | Mautino et al. | |
| 5,601,031 A | * | 2/1997 | Carlson | 105/199.3 |
| 5,753,055 A | * | 5/1998 | Liu | 148/545 |
| 5,878,897 A | | 3/1999 | Lazzaro et al. | |
| 6,258,180 B1 | | 7/2001 | Wilde et al. | |

OTHER PUBLICATIONS

Advanced Cast Products, Inc., CASTUF Superior Austempered Ductile Iron, no date provided. (no date).

RTZ Iron & Titanium Inc., A Design Engineer's Digest of Ductile Iron, no date provided, Montreal, CA.

John R. Keough, P.E. Markets for Ductile Irton and ADI, 2000, USA.

Applied Process, Inc., Better Materials for Tough Engineering Applications, no date provided, USA.

The Benefits of Using ADI, no date provided.

John R. Keough, P.E., Austemepered Ductile Iron Versus Aluminum: No Contest, 2001, USA.

John R. Keough and Dr. Kathy L. Hayryen, Automotive Applications of Austempered Ductile Iron (ADI), (no date).

Dr. Katrin Madler, On the Suitability of ADI As An Alternative Material for (Railcar) Wheels, 2000.

Bela V. Kovacs, Austempered Ductile Iron: Fact and Fiction, Cover Story, Mar. 1990, USA.

John R. Keough, P.E., An ADI Market Primer, Reprinted from Oct./Nov. 1995 Foundry Management and Tech.

Ductile Iron Data for Design Engineers, book, no date provided.

* cited by examiner

*Primary Examiner*—Mark T. Le
(74) *Attorney, Agent, or Firm*—John W. Harbst

(57) ABSTRACT

A railcar draft gear housing formed from an austempered ductile iron casting having an original shape and including an open end, a closed end, and wall structure axially extending between the housing's ends. The wall structure of the housing defines an axial section between and spaced from the ends. The axial section of the wall structure is configured to withstand impact energy imparted to the housing in excess of 81,000 inch pounds while retaining and exhibiting substantially linear elasticity wherein the resultant ratio of stress to energy input remains substantially constant thereby allowing for flexible distortion of the housing in a manner promoting enhanced energy damping characteristics while allowing the casting to return to the original shape after the impact energy is released threrefrom.

14 Claims, 4 Drawing Sheets

HOUSING 50

| DROP HEIGHT INCHES | REACTION FORCE Kips. | STRAIN INCH/INCH | Psi STRESS |
|---|---|---|---|
| 0.0 | 38 | 0.000254 | 1,566 |
| 0.5 | 178 | 0.001096 | 12,348 |
| 1.0 | 350 | 0.002057 | 19,833 |
| 1.5 | 497 | 0.002720 | 28,615 |
| 2.0 | 615 | 0.003190 | 34,478 |
| 2.5 | 727 | 0.003573 | 40,482 |
| 3.0 | 852 | 0.004007 | 49,540 |
| 3.5 | 944 | 0.004691 | 55,495 |
| 4.0 | 1,013 | 0.005167 | 62,254 |
| 4.5 | 1,093 | 0.005614 | 66,921 |
| 5.0 | 1,189 | 0.006010 | 72,180 |
| 5.5 | 1,200 | 0.006399 | 64,718 |
| 6.0 | 1,299 | 0.006776 | 70,105 |

COMPARABLE PRIOR ART STEEL HOUSING

| DROP HEIGHT INCHES | REACTION FORCE Kips. | STRAIN INCH/INCH | STRESS Psi |
|---|---|---|---|
| 0.0 | 25 | 0.000086 | 2,489 |
| 0.5 | 181 | 0.000454 | 13,158 |
| 1.0 | 371 | 0.000953 | 27,648 |
| 1.5 | 538 | 0.001503 | 37,776 |
| 2.0 | 645 | 0.001601 | 46,428 |
| 2.5 | 747 | 0.001818 | 52,708 |
| 3.0 | 856 | 0.002211 | 64,133 |
| 3.5 | 961 | 0.002638 | 62,294 |
| 4.0 | 1,039 | 0.003139 | 91,045 |
| 4.5 | 1,128 | 0.004266 | 123,707 |
| 5.0 | 1,186 | 0.005284 | 152,230 |
| 5.5 | 1,243 | 0.006446 | 186,624 |
| 6.0 | 1,284 | 0.007075 | 205,297 |

HOUSING 50

| DROP HEIGHT INCHES | REACTION FORCE Klbs. | STRAIN INCH/INCH | Psi STRESS |
|---|---|---|---|
| 0.0 | 38 | 0.000254 | 1,966 |
| 0.5 | 178 | 0.001096 | 12,548 |
| 1.0 | 350 | 0.002067 | 19,833 |
| 1.5 | 487 | 0.002729 | 28,615 |
| 2.0 | 615 | 0.003190 | 34,478 |
| 2.5 | 727 | 0.003573 | 46,482 |
| 3.0 | 852 | 0.004207 | 49,540 |
| 3.5 | 944 | 0.004691 | 55,495 |
| 4.0 | 1,013 | 0.005167 | 62,254 |
| 4.5 | 1,093 | 0.005614 | 69,321 |
| 5.0 | 1,189 | 0.005916 | 72,180 |
| 5.5 | 1,200 | 0.006399 | 64,718 |
| 6.0 | 1,299 | 0.006776 | 70,165 |

COMPARABLE PRIOR ART STEEL HOUSING

| DROP HEIGHT INCHES | REACTION FORCE Klbs. | STRAIN INCH/INCH | STRESS Psi |
|---|---|---|---|
| 0.0 | 25 | 0.000086 | 2,489 |
| 0.5 | 181 | 0.000454 | 13,158 |
| 1.0 | 371 | 0.000953 | 27,648 |
| 1.5 | 538 | 0.001303 | 37,776 |
| 2.0 | 645 | 0.001601 | 46,428 |
| 2.5 | 747 | 0.001818 | 52,708 |
| 3.0 | 856 | 0.002211 | 64,133 |
| 3.5 | 961 | 0.002838 | 82,294 |
| 4.0 | 1,039 | 0.003139 | 91,045 |
| 4.5 | 1,138 | 0.004266 | 123,707 |
| 5.0 | 1,198 | 0.006284 | 182,230 |
| 5.5 | 1,243 | 0.005849 | 169,624 |
| 6.0 | 1,284 | 0.007079 | 205,297 |

RAILCAR DRAFT GEAR HOUSING

FIELD OF THE INVENTION

This invention generally relates to an energy management system subjected to extremely high impacts loads applied thereto, and more particularly, to a railcar draft gear housing configured to offer enhanced energy dampening capabilities to a railcar draft gear assembly while advantageously being both stronger and weighing significantly less than the same type prior art draft gear housing.

BACKGROUND OF THE INVENTION

Energy management systems are used in a variety of industrial applications wherein a vehicle is subjected to extremely high impact loads and forces during operation. For example, in the railroad industry, an energy management system in the form of draft gear assemblies have been in widespread use on rolling stock for many decades. A railcar draft gear assembly is used to cushion shocks and dissipate energy encountered by railway rolling stock during make-up and/or operation of a train consist on track structure. The draft gear assembly typically nests in a pocket of a railcar center sill. A typical draft gear assembly includes a housing having a closed end, which abuts a rear wall of the pocket within the car sill, and an open end.

It is recognized by persons skilled in the railcar draft gear art, these draft gear assemblies must maintain certain minimum shock absorbing capacity during in-track service. The railcar industry furthermore continues to express interest in new, higher capacity draft gear assemblies. Presently, minimum shock absorbing capacity is specified by the Association of American Railroads (AAR) Standards.

To accomplish and meet these standards, it is known to equip such railcar draft gear assemblies with a suitable spring biased mechanism arranged primarily within the confines of the draft gear housing. A portion of the spring biased mechanism extends axially beyond the housing to engage and operate in combination with a follower plate. During in-track service, it is inevitable that energy imparted to the railcar draft gear exceeds the reaction capacity of the spring biased mechanism. As such, the draft gear spring biased mechanism assumes an "over-solid" condition and all remaining energy is imparted to the draft gear housing. As will be appreciated by those skilled in the art, and while occurring on a frequent basis, the energy required for the spring biased mechanism to assume an "over-solid" condition is exceedingly substantial, i.e. in excess of 600,000 inch pounds. After the spring biased mechanism reaches its "over-solid" condition, any excessive energy is thereafter transferred through the draft gear housing into the car sill and car body and, ultimately, to the lading carried therewithin. Such energy imparted to the car frequently causes significant damage to the lading carried within the railcar.

The railcar draft gear housing has been heretofore designed from exceedingly massive ferrous metal, i.e., steel castings which can withstand repetitive high energy impacts after the spring biased mechanism has achieved an "over-solid" condition without stress break or fracture. Such castings, however, typically require further machining and/or other secondary operations prior to incorporation of the spring biased mechanism therewithin. As will be appreciated, such processes and/or operations require trained manual efforts adding to the draft gear assembly costs without contributing any appreciable benefit to its performance characteristics.

With ever increasing fuel costs, there are continuing and concerned efforts in the railroad industry to increase productivity. Historically, increases have been achieved by increasing the rolling stock comprising a train consist and additionally the capacity of the railcars. Of course, increasing the rolling stock comprising a train consist furthermore adds to the dynamic energy transferred between adjacent cars comprising the consist. AAR Standards regarding regulating the size of the railcars along with the practical load limit of today's railroad track system, however, has generally been reached. Accordingly, attention is now being directed to other areas. For example, lightening of the overall weight of the rolling stock without sacrificing or unreasonably increasing costs is an on-going goal and would improve railcars.

In the mid 1990's, the North American railroad industry transported approximately 1.2 trillion ton-miles of lading in a fleet consisting of about 1.5 million railroad cars with a revenue of about $31 billion. Since the mid 1990's, such statistics have only increased. Accordingly, and although minor improvements may seem trivial when viewed with a narrow perspective, the overall benefits to be achieved can be significant. Even when considering individual train consists, it will be apparent, in a train consist comprised of 100 cars, a mere five pound reduction in weight of duplicated railcar components translates to one-half ton weight reduction per train. As will, be appreciated, reducing the cumulative empty weight of the 100 car train consist by one-half ton allows that same train consist to transport an additional 1000 pounds of lading with no additional costs being added.

Thus, there is a need and continuing desire for a railcar draft housing which is even stronger than known draft gear housing of the same type and allow such draft gear housing to sustain excessive energy applied thereto but is also significantly less weight whereby contributing to fuel savings and increased train lading capacity and which can be manufactured to such close tolerances whereby substantially eliminating the need for subsequent and expensive machining and/or other secondary operations prior to actual use on the railcar.

SUMMARY OF THE INVENTION

In view of the above, and in accordance with the present invention, there is provided a new and improved housing for an apparatus or energy management system. In one form, there is provided a railroad draft gear housing having improved operating characteristics which can be manufactured at a lower cost than heretofore known draft gear housing of a similar type. Although the material of the railcar draft gear housing has been modified along with its cross-sectional dimensions, it advantageously remains and retains its interchangeability with draft gear housings serving the same purpose while offering an improved strength to weight ratio. The present railcar draft gear housing is especially advantageous in that it is not only stronger than prior railcar draft gear housings of the same type, it is also significantly lighter in weight thereby contributing to fuel savings and/or increased lading capacity for the associated railcar.

In accordance with a first aspect, there is provided a railcar draft gear housing which combines the strength, ductility, fracture toughness and wear resistence of steel with the castability and product economies of ductile iron. The draft gear housing of the present invention is produced from an austempered ductile iron casting having an open end, a closed end, and wall structure axially extending between the housing's ends. The wall structure of the housing defines an axial section between and spaced from the ends. In accordance with the present invention, the axial section of the wall structure is designed and configured to act as an elastic member which is capable of withstanding impact energy imparted to the casting in excess of 81,000 inch pounds while retaining and exhibiting substantially linear elasticity wherein the resultant ratio of stress to energy input remains substantially constant. That is, and unlike heretofore known steel draft gear housings, the wall structure of the draft gear housing is designed and configured to flexibly distort within a yield range of austempered ductile iron whereby advantageously serving to absorb, dissipate and return energy imparted thereto during operation of the railcar and thereby enhancing overall operation of a draft gear assembly, of which the housing forms an integral part, without increasing the cost of such assembly.

Research has revealed superior results are obtainable when the railcar draft gear housing is preferably formed from a grade of ductile iron selected from the group consisting of: ASTM Grade 1 ductile iron through ASTM Grade 5 ductile iron. To accomplish the preferred goal of interchangeability mentioned above, the railcar draft gear casting preferably measures between about 14 inches and about 29 inches in axial length between the open and closed ends. Moreover, and to significantly lessen the overall weight of the draft gear assembly, the axial section of the sidewall structure for the railcar draft gear housing has a cross-sectional area measuring between about 9.5 inches and about 17.5 inches. Accordingly, the casting for the draft gear housing advantageously weighs only generally between about 75 lbs. and about 150 lbs.

In accordance with another aspect, there is provided a railcar draft gear housing produced from an as cast austempered ductile iron casting having an open end, a closed end, and wall structure axially extending between the ends. The wall structure defines an axial section spaced from and between said ends for absorbing, dissipating and returning energy imparted to said housing resulting from impact loads applied thereto. Additionally, the axial section of the wall structure has a minimum yield strength ranging between about 100 ksi. and about 150 ksi., with a minimum compression in 2 inches ranging between generally about 3% and about 15%, and with a BHN within a range of generally between about 300 and about 500. The ability of the axial section of the housing's wall structure to absorb impacts without fracture or breakage beyond a range permitted with steel castings of the prior art coupled with the ability of the as-cast austempered ductile iron casting to return to its original state or condition provides the draft gear housing with a unique ability and structural characteristic contributing significantly improved performance to the draft gear assembly during railcar operation without requiring costly and time-consuming machining and other secondary operations to be performed on the draft gear housing.

The railcar draft gear housing casting is furthermore preferably configured with a series of openings arranged toward the housing's closed end to eliminate and minimize unnecessary mass and reducing the overall weight thereof, thus, increasing the load carrying capacity of the railcar. In a preferred embodiment, the sidewall structure of the casting, including the axial section, has a generally cylindrical cross-sectional configuration extending between the housing's ends. The axial section of the wall structure has a cross-sectional area measuring only between about 9.5 inches and about 17.5 inches. Preferably, the generally cylindrical cross-sectional configuration of the casting, at least through the axial section, has a generally uniform thickness whereby allowing the railcar draft gear housing to retain and exhibit substantially linear elasticity wherein the resultant ratio of stress to energy input remains substantially constant even after the energy imparted solely to the housing exceeds 81,000 inch pounds.

Still another aspect relates to providing a railcar draft gear assembly including a spring assembly for dissipating energy forces imparted to said draft gear assembly and a housing which surrounds the spring assembly. The draft gear housing is formed from a high strength, low-alloy, austempered composite metal material whose mechanical properties can be varied over a wide range by a suitable choice of heat treatment and having a density of generally about 0.25 lb./cu. in. The housing includes an open end, a closed end, and wall structure axially extending between the opposed ends. The housing wall structure includes a tubular axial section designed to offer over-solid energy absorption protection to the draft gear assembly. That is, and following the spring assembly acting to effect energy absorption equal to or in excess of 600,000 inch pounds and being compressed into an "over-solid" condition, the draft gear housing is designed and configured to provide the draft gear assembly with an at least an additional 81,000 inch pounds of energy absorption capability while retaining and exhibiting substantially linear elasticity wherein the resultant ratio of stress to energy remains substantially constant whereby enhancing the overall life expectancy of the railroad equipment.

According to still another aspect, there is provided an apparatus which, during operation, is subjected to repeated axial loadings applied thereto. The apparatus includes an as-cast elongated member formed from an austempered composite material having a density of about 0.25 lb./cu.in., and wherein said elongated member has first and second axially spaced ends with wall structure axially extending between said ends, with said wall structure including an axial section configured and designed to offer over-solid energy absorption protection for said apparatus and is configured to withstand impact energy in excess of 81,000 inch pounds while retaining and exhibiting substantially linear elasticity wherein the resultant ratio of energy input remains substantially constant.

Accordingly, one object of the present invention is to provide a new and improved housing for an apparatus or energy management system which is not only interchangeable with but is also stronger and lighter than a comparable energy management system steel housing now in use whereby contributing to fuel savings and/or increased lading capacity for the apparatus or vehicle with which the energy management system is in operable combination.

Another object of the present invention is to provide a railcar draft gear housing having at least one axial section capable of absorbing, dissipating and returning impact forces imparted to the housing whereby adding enhanced dampening of excessive energy imparted thereto and, thus, contributing to improved performance of a draft gear assembly than heretofore obtainable with known steel housings.

Yet another feature of the present invention relates to the provision of a railcar draft gear housing which is made of a stronger base material which permits openings to be designed into the housing to enhance weight and material reduction essentially without sacrificing strength.

An even further object of this invention relates to the provision of a railcar draft gear housing which is made from a high strength, low alloy, austempered composite material which is lighter in weight and less costly than materials heretofore used for railcar draft gear housings.

These and other objects aims and advantages of the present invention will become readily apparent from the following detailed description, drawings and appended claims.

DESCRIPTION OF THE INVENTION

Figure 1:
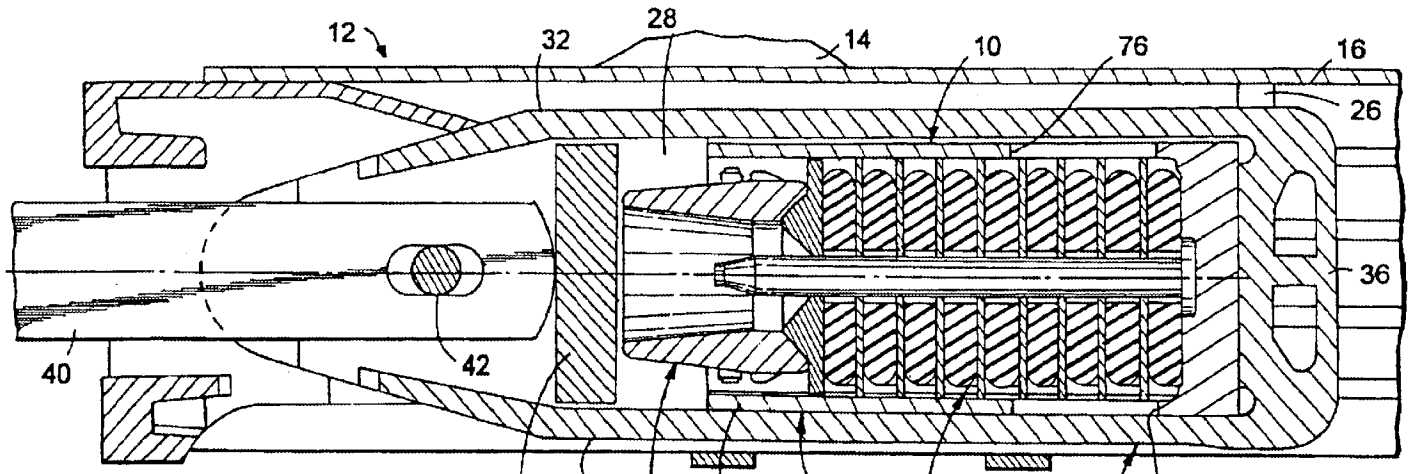
FIG. 1 is a fragmentary side sectional view showing one form of a draft gear assembly embodying features of the present invention arranged in a pocket of a railcar centersill, with component parts being shown in section.

While the present invention is susceptible of embodiment in multiple forms, there is shown in the drawings and will hereinafter be described a preferred embodiment of the invention, with the understanding the disclosure is intended to set forth an exemplification of the invention which is not intended to limit the invention to the specific embodiment illustrated and described.

Referring now to the drawings wherein like reference numerals indicate like parts throughout the several views, there is shown in FIG. 1 an energy management system, generally identified by reference numeral 10, and embodying features of the present invention. In the exemplary embodiment, the energy management system 10 is illustrated as a railcar draft gear assembly. As will be appreciated by those skilled in the art, each railcar is provided, toward opposed ends, with a railcar draft gear assembly which functions to dissipate energy between adjacent railcars. It will be appreciated, however, the teachings and advantages of the present invention equally apply to other forms or types of energy management systems without detracting or departing from the spirit and scope of the present invention.

In the example illustrated, the railcar draft gear assembly 10 is arranged in operable association with a longitudinal centersill 12 of a railcar, generally identified by reference numeral 14. In the exemplary embodiment, the railcar centersill 12 has a top wall 16 with a pair of laterally spaced sidewalls 17 and 18 (FIG. 2) depending therefrom. It should be appreciated, however, the draft gear assembly of the present invention can be used in railcar sills not having a top wall. Advantageously, no modifications or changes are necessary to conventional cast or fabricated railcar centersills to enable use with the draft gear assembly of the present invention.

Figure 2:
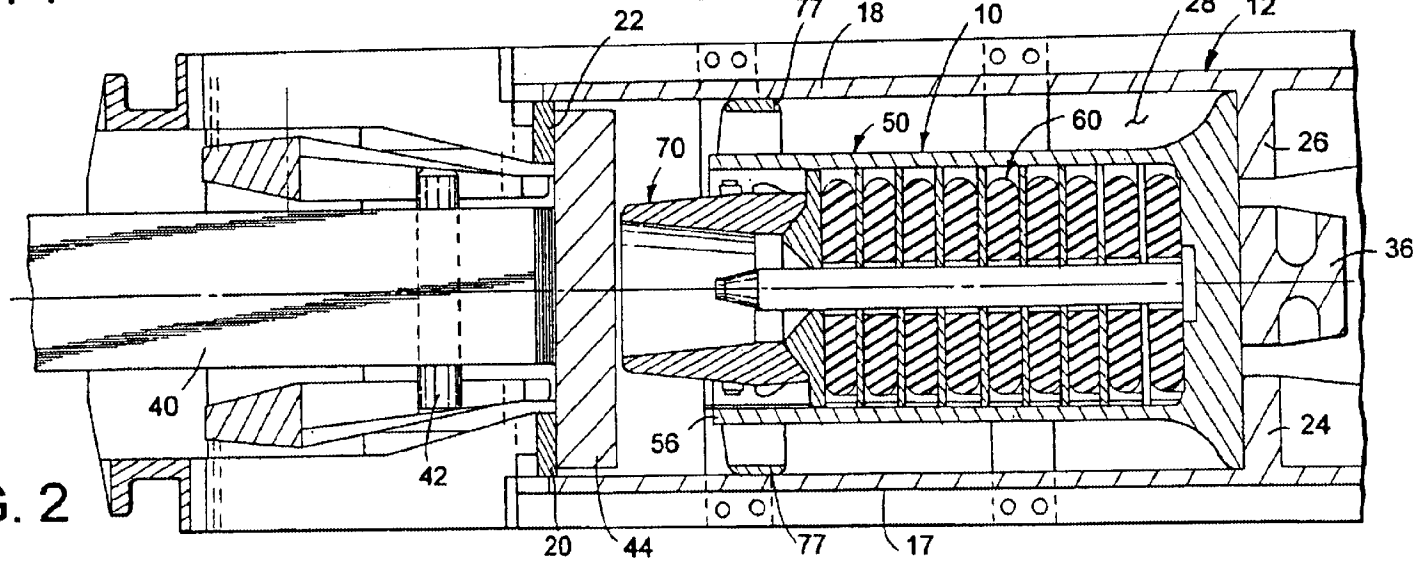
FIG. 2 is a fragmentary top sectional view of the draft gear assembly shown in FIG. 1 arranged in operable combination within the pocket of the railcar centersill, with component parts being shown in section.

In the embodiment shown in FIG. 2, the railcar centersill 12 includes a pair of laterally spaced front stops 20 and 22 and a pair of laterally spaced rear stops 24 and 26. The stops 20, 22 are axially spaced from stops 24, 26 to define a pocket 28 wherein the draft gear assembly 10 is accommodated as either a new or interchangeable repair/replacement assembly for the railcar. In addition to those conventional features mentioned, the centersill 12 can have other standard features and can be manufactured of standard materials using conventional, well known practices. Suffice it to say, the centersill pocket 28 on railcar 14 has an axial or longitudinal distance ranging between about 16 inches and about 36 inches provided between the stops 20, 22 and 24, 26. In a most preferred embodiment, the centersill pocket 28 has an axial or longitudinal distance of about 24.625 inches between the stops 20, 22 and 24, 26.

Returning to FIG. 1, a conventional generally U-shaped yoke 30, having longitudinally extending and vertically spaced arms 32, 34 joined at one end to a wall 36, is arranged in operable combination with the draft gear assembly 10. Preferably, the yoke 30 is a one-piece unit. As shown in FIGS. 1 and 2, a free end of a standard coupler shank 40 extends between the spaced ends of arms 32 and 34 and is articulately joined to yoke 30 through a coupler pin 42. A conventional follower plate 44, movably carried within pocket 28, is operably associated with the end of the coupler shank 40 and effectively transfers energy between coupler shank 40 and the railcar draft gear assembly 10.

Figure 3:
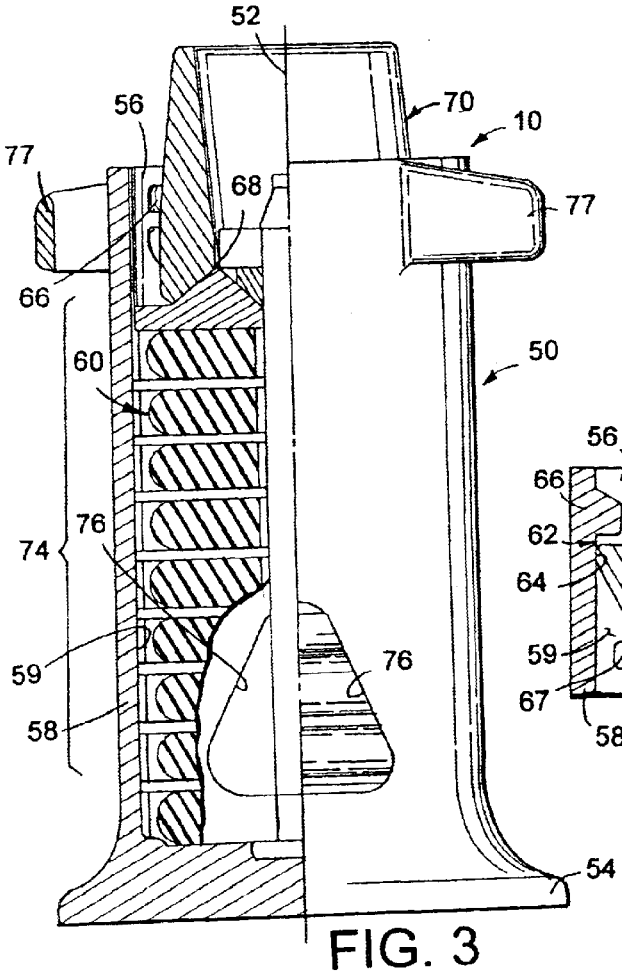
FIG. 3 is an enlarged longitudinal cross-sectional view of the draft gear assembly illustrated in FIGS. 1 and 2.

Turning to FIG. 3, the railcar draft gear assembly 10 generally includes a housing 50 and a spring mechanism 60 for dissipating energy axially imparted to the draft gear assembly during operation of the railcar 14. As shown, draft gear housing 50 defines a longitudinal centerline 52 and has a base 54 defining a closed end for housing 50, an open end 56, and a relatively thin, fine featured wall structure 58 axially extending between the axially spaced ends 54, 56. The draft gear housing 50 can measure between about 14 inches and about 29 inches in length between the ends 54, 56 depending upon the longitudinal opening defined by the centersill pocket 28. With the longitudinal distance of the centersill pocket 28 measuring about 24.625 inches, the draft gear housing 50 will measure about 22.375 inches in length between ends 54, 56. In the one form, and with those exceptions noted below, the draft gear housing wall structure 58 has a generally tubular or hollow configuration defining a spring chamber 59 extending the majority of its length.

Base 54 of housing 50 preferably has a generally rectangular configuration for facilitating transfer of energy applied to the draft gear assembly 10 to the stops 24, 26 on the centersill 12 (FIG. 2). In a preferred form, wall structure 58 has a generally cylindrical cross-sectional configuration for a major portion of its length. Notably, and as shown in FIG. 3, in the area where the cylindrical-like configuration of the wall structure 58 is integrally joined to the base 54, a round or curved transitional area is provided whereby reducing the creation of a stress concentration area in the housing 50.

As shown, the draft gear housing 50 is arranged in surrounding relation relative to the spring mechanism or assembly 60. The spring assembly 60, accommodated in the spring chamber 59 of housing 50, can be of any of a myriad of different conventional designs and types, i.e., one or more steel springs and/or a stack of elastomeric spring pads, or a combination of both.

Figure 4:
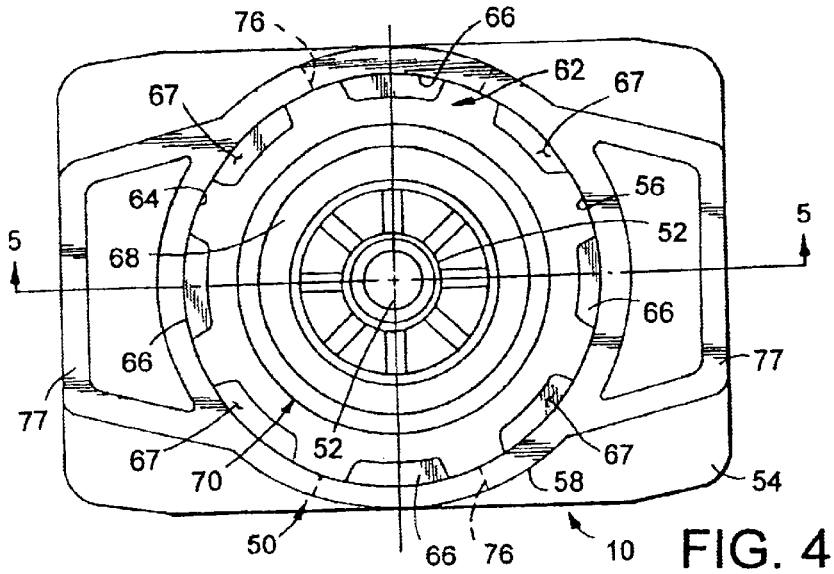
FIG. 4 is a plan view of the draft gear assembly illustrated in FIG. 3.
Figure 5:
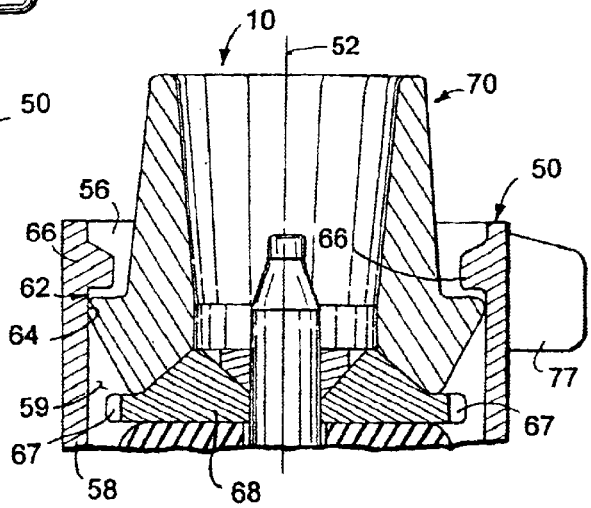
FIG. 5 is a fragmentary sectional view taken along line 5—5 of FIG. 4.

As shown in FIGS. 4 and 5, the housing 50 and spring mechanism 60 are provided with cooperating instrumentalities 62 for allowing a significant preload force to be imparted to the spring mechanism 60 of the draft gear assembly 10. In the illustrated embodiment, and toward the open end 56 of housing 50, an inner surface 64 of the housing wall structure 58, is provided with a series of equally and radially spaced lugs 66 which project toward the longitudinal centerline 52 of the draft gear housing 50. These draft gear housing lugs 66 are adapted and configured to cooperate with suitably arranged openings 67 defined by a spring seat 68 arranged in spring chamber 59 (FIG. 5) of housing 50 in operable combination with one end of the spring mechanism 60. The other end of the spring mechanism 60 engages an interior surface at the closed end 54 of housing 50. As will be appreciated, the cooperating instrumentalities 62 between housing 50 and spring mechanism 60 can take any of a myriad of other different designs and shapes without detracting or departing from the spirit and scope of the present invention.

Spring assembly 60 furthermore operably includes a plunger 70 arranged in operable combination with the spring seat 68. As will be appreciated, plunger 70 axially moves with the spring seat 68 in response to energy being axially directed or imparted to the draft gear assembly 10. As shown, and during operation of the draft gear assembly 10 (FIGS. 1 and 2), a lengthwise portion of plunger 70 extends axially beyond the open end 56 of the draft gear housing 50 for operable engagement with the follower plate 44 carried within the centersill pocket 28. In one form, the free end of plunger 70 extends about 1.625 inches beyond the open end 56 of housing 50. As will be appreciated, and with reduced or no energy being imparted to the draft gear assembly 10, the preload of spring mechanism 60 maintains the draft gear housing base 54 in abutting relationship with the stops 24, 26 of the centersill pocket 28 while the free end of the plunger 70 urges the follower plate 44 into engagement with the stops 20, 22 at the opposite end of the draft gear housing pocket 28.

The draft gear housing 50 of this invention is similar to those of the prior art in order to maintain interchangeability, with a first primary difference being the wall structure 58 of draft gear housing 50 has an axial section, generally identified in FIG. 3 by reference numeral 74, which is designed and configured to advantageously absorb, dissipate and return energy imparted thereto. That is, during operation of the draft gear assembly, and after the spring mechanism 60 reaches or is moved to an "over-solid" condition, the draft gear housing 50 remains operable to further dampen excessive energy not absorbed by mechanism 60 and applied directly to the housing 50 and which exceeds that level of energy sustainable with prior art devices.

In addition, and as a second primary difference, the inventive draft gear housing 50 has a superior strength to weight ratio, i.e., housing 50 is stronger and more durable than prior art steel draft gear designs As a result, the draft gear housing 50 can offer significantly longer service life, thus, reducing downtime required for servicing the draft gear assembly 10 and improving operating expenses of the railcar using such railcar draft gear housing As another primary difference between the inventive draft gear housing 50 and prior art draft gear housing designs, the cross-sectional area of the wall structure 58 comprising the majority of the housing 50 and axially extending between opposed housing ends 54 and 56 has been significantly reduced. Moreover, and with cut-outs or openings described below, the draft gear housing 50 is of significantly lighter weight than comparable prior art draft gear housing designs. As will be appreciated, reducing the overall weight of the draft gear assembly 10 undoubtedly contributes to both fuel savings, material costs, and furthermore allows the lading capacity for the associated railcar to be increased without adding significant costs to the railcar.

While internal dimensions of the draft gear housing spring chamber or cavity 59 are comparable to prior art designs whereby eliminating concerns over effective operation of tested spring mechanisms 60, the outer dimensions of the draft gear housing 50 have been significantly altered to reduce the cross-sectional size of the casting and, thus, reducing the weight thereof. Typical prior art steel draft gear housings are designed with a cross-sectional area having a minimum measurement of about 20.0 square inches and ranging as up to 24.5 square inches. Such cross-sectional designs have been required to enable those prior art draft gear steel housings to withstand the excessive levels of energy axially applied thereto In contrast, the inventive draft gear housing 50 has a cross-sectional area measuring between generally about 9.5 square inches and about 17.5 square inches. As such, even the maximum 17.5 square inch cross-sectional area design of the inventive draft gear housing 50 is well outside the minimum cross-sectional area of prior art draft gear housing designs.

The draft gear housing 50 of this invention is furthermore different from steel draft gear housings of the prior art in that the inventive draft gear housing 50 is fabricated from a high strength, low alloy metal composite having a density of about 0.25 lbs./cu. inch, which is heat treated, and has a minimum yield strength ranging between about 100 ksi. and about 150 ksi., with a minimum compression in 2 inches ranging between generally about 3% and about 15%, and with a BHN within a range of generally between about 302 and about 500.

One of the more important considerations in making the high strength housing 50 is to minimize the defects inside and on the surface of the castings. Of course, near net shape casting technology will reduce the costs of production. Accordingly, and to better control the dimensional limits, the inventive housing 50 is preferably cast using a lost-foam technique or process to achieve an as-cast configuration. With such technique, polyaryrene or polymethyl methacrylate is shaped into a foam replica of the housing 50 and from which gating is attached. Loose sand is vibrated therearound to form a mold with gating into which molten metal is poured. As the molten metal is poured into the mold, the foam replica is vaporized by the molten metal, and the hot cast metal takes its place to form the casting within the sand mold. As such, subsequent machining operations and related time consuming secondary operations normally required with castings is substantially eliminated. Alternatively, a green sand molding process could also be used whereby producing an as-cast configuration for the housing 50. The lost foam method and related casting techniques are well known in the foundry art and, thus, no further description need be provided therefor.

Because of the superior strength of housing 50, at least one and preferably a pair of cut-outs or openings 76 can be provided therein to effect further weight reduction by selectively eliminating any unnecessary portions of the casting. As shown, and without any adverse effect on the overall strength or life of the housing 50, the openings 76 are preferably disposed toward the closed end 54 of the housing and extend toward the open end 52 of housing 50. Because loading on the housing 50 is primarily compressive, and dissipation of the energy imparted to the housing 56 is primarily effected by the sidewall structure 58 axially extending from the open end 56 of the housing 50, the arrangement of the openings 76 toward the closed end 54 of the housing 50 have a minimal adverse effect on the overall strength of the housing 50.

The inclusion of such openings or reliefs 76 in the casting 50 will not only reduce the weight thereof, but will furthermore serve to reduce the amount of material necessary to cast such housing 50. Of course, and as will be appreciated by those skilled in the art, lesser materials used in the housing 50 will furthermore facilitate the heat treating process described in further detail below. Moreover, configuring the openings or recesses 76, i.e., providing a triangular shape to the openings 76, will furthermore advantageously facilitate transfer of energy along the sidewall structure 58 to the closed end 54 and, ultimately, to the stops 24, 26 on the centersill 12 of the railcar. While the two above described openings 76 are included in the presently preferred embodiment of housing 50, it will be appreciated other cut-outs or reliefs having alternative configurations from that shown can also be included if additional weight reduction is desired.

Toward the open end 56, housing 50 is preferably configured with diametrically opposed guides 77 radially extending outwardly from and formed integral with an outer surface of the housing wall structure 58. As shown, each guide 77 is preferably configured as a handle whereby facilitating handling of the housing 50. To effectively serve their purpose, the overall distance measured transversely between an outermost radial surface of the two guides 77 is slightly less than the distance measured between the two laterally spaced sidewalls 17, 18 (FIG. 2) of the railcar centersill 12. As such, the guides 77 promote unhindered axial movements of the draft gear assembly housing 50 within the centersill pocket 28 in response to both buff and draft loads being imparted to the draft gear assembly 10 (FIG. 1) during operation of the railcar 14.

Referring again to FIG. 3, and unlike prior art draft gear housing having varying wall thicknesses along the axial length of the draft gear housing, a salient feature of the innovative and new housing 50 relates to configuring the wall structure 58, and especially an axial section 74 of the wall structure 58, with a generally uniform cross-section. Notably, the preferred uniform cross-sectional configuration for the wall structure 58, and especially the axial section 74 embodies a significant lengthwise portion of the draft gear housing 50 with a resiliently deformable characteristic when excessive energy is applied thereto and which recovers to its original configuration when such excessive energy is released therefrom.

It should be appreciated, however, and without detracting or departing from the spirit and scope of the present invention, the housing wall structure 58 can be comprised of more than one similarly shaped or configured axial section 74. In such an alternative design, the axial sections 74 would be axially separated from each other along the length of wall structure 58 and, during operation of the draft gear assembly, cooperate with each other to provide the housing 50 with a heretofore unachieved energy absorbency thereby enhancing the dampening effect provided by the housing 50. Regardless of whether one or more axial sections 74 are included as part of the housing wall structure 58, suffice it to say configuring and designing one or more axial sections 74 of the draft gear housing wall structure 58 with a generally uniform thickness yields a draft gear housing design which can retain and exhibit substantially linear elasticity wherein the resultant ratio of stress to energy input remains substantially constant even after the energy imparted to the assembly housing 50 exceeds 81,000 inch pounds, while furthermore facilitating an austempereing heat treatment process for the housing 50 described in further detail below.

For commercial purposes, the inventive draft gear housing 50 is produced or formed from a grade of ductile iron selected from the group consisting of ASTM Grade 1 ductile iron through ASTM Grade 5 ductile iron (ASTM 897/897M). These particular grades of ductile iron are said to be heat treatable ductile irons to which relatively small amounts of nickel, molybdenum, silicon, manganese or copper have been added to improve the desired hardenability and to derive the required strength and hardness properties required for sustained operation of a railcar draft gear wherein enormous impact loads are regularly and consistently imparted thereto. In a most preferred embodiment, an ASTM Grade 2 ductile cast iron forms the draft gear housing 50.

The alloy content or elemental composition of the ductile iron is necessary for hardenability purposes or the austemperability of the ductile iron. Without detracting or departing from the spirit and scope of the present invention, the chemical or elemental composition of the ductile iron can vary and will, ultimately, be established between the foundry and the heat treater. One presently preferred metallurgical or elemental chemical composition of the ductile iron used to form the housing 50 is: carbon, in a range of between 3.6 and about 3.75 weight %; silicon, in a range of about 2.4 and about 2.8 weight %; nickel, having a maximum of about 2.0 weight %; manganese, in a range of between about 0.18 and about 0.35 weight %; molybdenum, in a range of between about 0.14 and about 0.19 weight %; copper, in a range of about between about 0.40 and about 0.80 weight %; and, sulfur, having a maximum of about 0.015 weight %; with the remaining balance, of course, being iron. In a most preferred form, it is desirable to maximize the alloy content of nickel and copper since this is likely to lead to increase in retained austenite content. Retained austenite enhances energy absorption of the housing 50 and results in better toughness and fatigue strength.

It has been found the variables affecting as-cast ductile iron also affect austempered ductile iron. That is, the characteristics that result in good quality ductile iron also promote good austempered ductile iron. In general, the critical characteristics for the manufacture of austempered ductile iron can be generalized as: 100 nodules/mm$^2$ minimum; 90% minimum nodularity; 0.5% maximum carbides & inclusions; 1% maximum micro-shrinkage; minimum inclusion content; and, a controlled pearlite/ferrite ratio.

After the draft gear housing 50 is formed, the housing 50 is heat treated using an austempering process. Heat treatment of the housing 50, through its influence on microstructure of the alloyed casting, has a strong effect on energy absorption properties for the housing 50. More specifically, the casting is heated to an austensitized heat level sufficient to dissolve the carbon and yields high strength along with improved wear resistence combined with enhanced toughness. Unlike the relatively constant carbon concentration inherent with steel, regardless of the heat treatment applied thereto, and because of the presence of graphite particles, the carbon content of an austempered ductile iron matrix can vary depending upon on the thermal history to which the casting was subjected. Here, the casting forming housing 50 is heated until the entire casting is of a substantially uniform temperature above the $Ae_3$ temperature of the metal. As will be appreciated, the relatively uniform cross-section of the housing wall structure 58, and especially the axial section 74, advantageously facilitates heating of the casting to a substantially uniform temperature above the $Ae_3$ temperature of the metal. The optimum austenitizing temperature is dependent upon the elemental composition or chemistry of the ductile iron forming housing 50 and the strength grade desired. Moreover, the time the casting forming the housing 50 remains at the austenitizing temperature is equally as important as the choice of $Ae_3$ temperature and is a function of the elemental composition of the ductile iron forming the casting, the nodule count, and the section thickness of the casting. Suffice it to say, the casting forming the housing 50 will preferably be held at the $Ae_3$ or austenitizing temperature for a time sufficient to create an austenite matrix saturated with carbon. As will be appreciated, this time is additionally affected by the elemental composition or chemistry of the ductile iron forming housing 50.

After heating the casting to a substantially uniform temperature above the $Ae_3$ temperature, the casting is rapidly quenched, enough to avoid formation of pearlite, to a temperature in the lower bainite region just above the $M_\delta$ temperature, and held at that temperature for a time which is at least sufficient to cause transformation to form acicular ferrite precipitate within an austentite matrix. As in all austempered grades, carbon is rejected into the austentite matrix whereby the resulting microstructure of housing 50 is acicular ferrite in a carbon stabilized austentite, which is often designated ausferrite. This differs from bainite (found in steels) which is acicular ferrite and carbon. Once the ausferrite has been produced, the austempered housing 50 is cooled to room temperature. This cooling rate will not affect the final microstructure. As known, steel solidifies as a single phase solid. In contrast, an austempered ductile iron solidifies through an eutectic process. The solute distributors in steel are vastly different from the solute distributors in austempered ductile iron due to the different modes of solidification. Suffice it to say, the solute distribution alters the carbon kinetics in cast irons.

Figure 6:
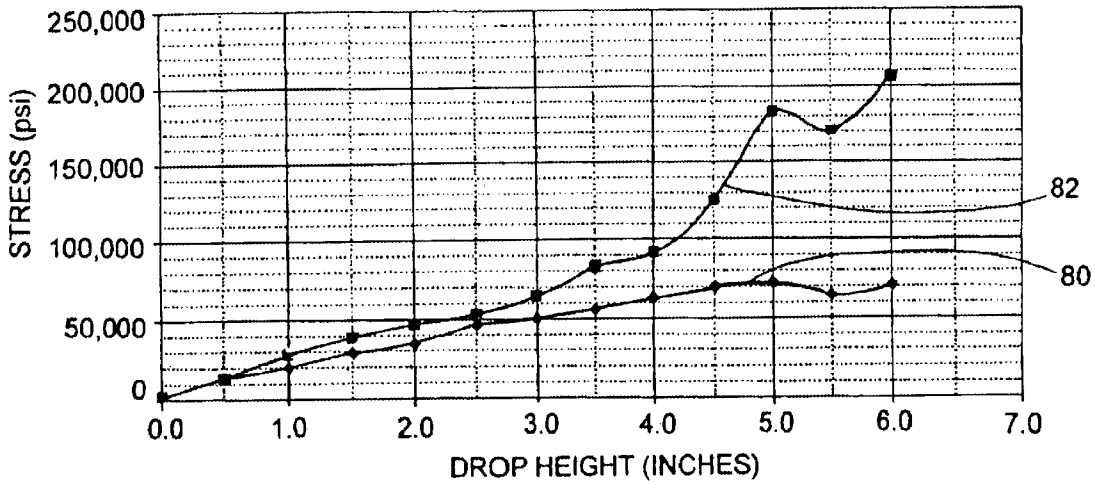
FIG. 6 is a diagrammatic comparison showing proportional limits of a housing according to the present invention and a comparable steel draft gear housing.

Turning now to FIG. 6, an example of the elasticity of the axial section 74 of housing 50 as compared to a similar area on a conventional steel draft gear housing is schematically illustrated. As graphically illustrated, the ability of both the innovative housing 50 and the prior conventional draft gear housing to absorb, dissipate and return like amounts of energy axially imparted to the respective housings remains substantially similar to a point.

After the axial application of about 81,000 inch pounds to the tested housings, however, there is a remarkable difference in their performance characteristics. More specifically, the energy absorption capacity of the inventive housing 50 tested is far greater than and exceeds conventional draft gear housings. Following an impact of about 81,000 inch pounds, the configuration and elemental composition of the innovative draft gear housing 50, permits the axial section 74 of housing 50 to react with an elasticity illustrated by curve 80. Notably, the elasticity of the housing section 74, illustrated by curve 80, remains substantially linear wherein the resultant ratio of stress to energy input is substantially constant. In contrast, and as will be apparent from the graph illustrated in FIG. 6, following the application of about 81,000 inch pounds to a conventional prior art draft gear casting, the elasticity or proportional limit of the prior art steel housing has been exceeded, and, as graphically illustrated by curve 82, is lost whereby indicating the prior art steel housing has fractured and failed. Thus, and as illustrated in FIG. 6, designing and configuring the wall structure 58 of the draft gear housing 50 with an axial section 74 as described above and having an elemental composition as described above, advantageously allows the draft gear housing 50 to exhibit absorption, dissipation and return of energy imparted thereto in a manner unachieved in the railcar draft gear housing arts.

Figure 7:
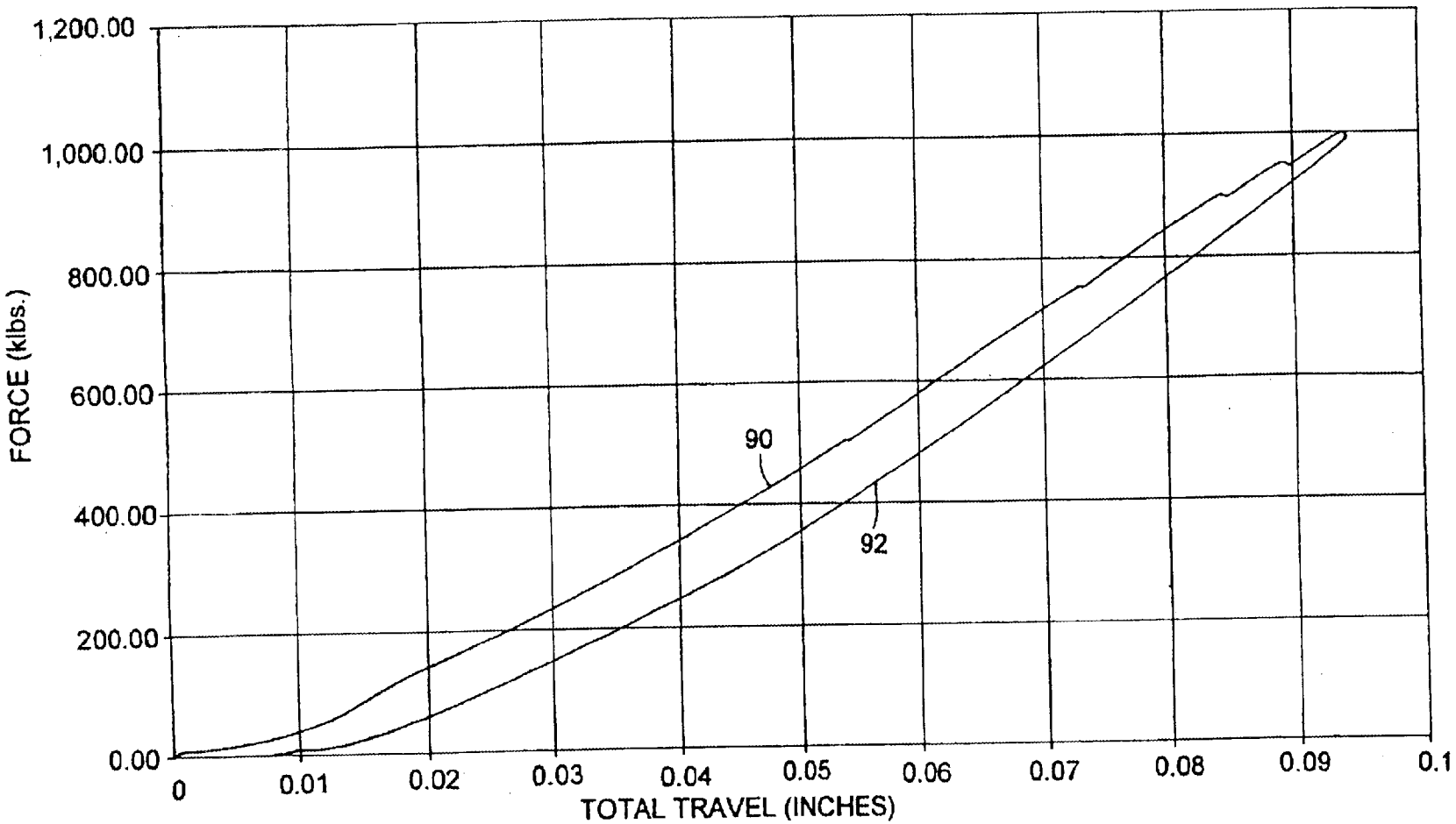
FIG. 7 is diagram showing characteristics of elasticity for an axial section of the draft gear housing according to the present invention.

A draft gear housing embodying features of this invention reacts to axial energy imparted thereto in the manner diagrammatically illustrated in FIG. 7. In FIG. 7, the upper curve 90 illustrates compression of the draft gear housing 50, after the spring mechanism 60 reaches an "over-solid" condition. The lower curve 92 indicates expansion of the of the draft gear housing 50 following a reduction in axial energy applied thereto. The complete cycle of compression and expansion in response to energy being axially applied to the draft gear housing 50 comprises a hysteresis loop, with energy being dissipated during the cycle. As will be appreciated, with such energy dissipation, the draft gear housing 50 acts as a damper which reduces the transfer of energy to the centersill 12 and, ultimately, to the loading within the railcar 14.

It will be understood, of course, the hysteresis loop illustrated in FIG. 7 is set forth by way of example only. A different austempered ductile iron composition for the draft gear housing 50 can shift the curves somewhat and, thus, produce a slightly different hysteresis loop without detracting or departing from the true spirit and scope of the present invention. It should be furthermore noted, the present invention is not limited to any particular austempered ductile iron composition providing any particular hysteresis loop and/or damping characteristic unless expressly set forth in the appended claims.

The ductile iron material used to form the draft gear housing 50 is less dense than other ferrous metals. Moreover, the heat tempering process coupled with the properties of the materials used to form the draft gear housing 50 allows the wall thickness for the axial section 74 to be less thick than required for heretofore used ferrous metals. Of course, reduced density of the material used to form the draft gear housing 50 coupled with a significantly lesser wall thickness cross-section readily translates to less weight for the draft gear housing 50. In fact, research has shown a draft gear housing embodying features of the present invention can weight 30% to about 40% less than a comparable draft gear housing formed from steel. Given the extremely long haul distances some railcars travel, railcar weight reductions are always sought after goals in the railcar industry. In one form, the draft gear of the present invention weighed about 50 pounds lighter than a comparable prior art draft gear housing formed from steel. Since, each railcar typically embodies two draft gear assemblies, a 100 pound reduction in the empty weight of the railcar, offered by the teachings of the present invention at lesser cost than heretofore known draft gear assemblies, is another significant advantage offered by the present invention over prior art steel draft gear housings.

After the spring mechanism 60 of the draft gear assembly 10 achieves or assumes an "over-solid" condition", and the remaining energy is applied to the draft gear housing of the present invention, the axial section 74 of wall structure 58 will flex or bulge radially outward whereby absorbing, dissipating, and, ultimately, returning such energy imparted to the draft gear housing 50 rather than merely passing or transferring such forces to the railcar. As such, the railcar draft gear housing 50 is specifically engineered and designed to offer and provide enhanced force damping qualities beyond those of prior art draft gear housing designs.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A railcar draft gear housing comprising:

an austempered ductile iron casting having an open end, a closed end, wall structure axially extending between said ends and wherein said casting has an original shape, with said wall structure defining an axial section between and spaced from said ends of said casting, and wherein said axial section of said wall structure has a generally uniform cross-sectional thickness along a length thereof ranging between about 9.5 inches and about 17.5 inches such that said axial section of said wall structure acts to absorb axial energy imparted to said casting in excess of 81,000 inch pounds while retaining and exhibiting substantially linear elasticity wherein the resultant ratio of stress to energy remains substantially constant so as to allow said casting to return to said original shape after the axial energy imparted to said casting is relieved.

2. The railcar draft gear according to claim 1 wherein said casting is formed from a grade of ductile iron selected from the group consisting of: ASTM Grade 1 ductile iron through ASTM Grade 5 ductile iron.

3. The railcar draft gear according to claim 1 wherein said casting has an axial length measuring between about 14 inches and about 29 inches between said open and closed ends.

4. The railcar draft gear according to claim 1 wherein said casting has a weight generally ranging between about 100 lbs. and about 150 lbs.

5. A railcar draft gear housing comprising:

an as cast austempered ductile iron casting having an open end, a closed end, wall structure axially extending between said ends and wherein said casting has an original shape, with said wall structure defines an axial section spaced from and between said ends of said casting, with said axial section having a generally uniform cross-sectional thickness along a length thereof measuring between about 9.5 inches an about 17.5 inches such that the axial section of the wall structure of said casting acts to absorb, dissipate, and return energy imparted to said housing and resulting from impact loads applied thereto in excess of 81,000 inch pounds while retaining and exhibiting substantially linear elasticity wherein the resultant ratio of stress to strain remains substantially constant so as to allow said casting to returns to said original shape after the axial energy imparted to said casting is removed, and with the axial section of said wall structure having a minimum yield strength ranging between about 100 ksi. and about 150 ksi., with a minimum compression in 2 inches ranging between generally about 3% and about 15%, and with a BHN within a range of generally between about 302 and about 500.

6. The railcar draft gear housing according to claim 5 wherein said casting defines a series of openings arranged toward the closed end for reducing the weight of said casting.

7. The railcar draft gear according to claim 5 wherein said casting is formed from a ASTM Grade 2 ductile iron.

8. The railcar draft gear according to claim 5 wherein said casting has an axial length measuring between about 14 inches and about 29 inches between said open and closed ends.

9. The railcar draft gear housing according to claim 5 wherein the wall structure of said casting, including said axial section, has a generally cylindrical cross-sectional configuration extending between said open and closed ends.

10. A railcar draft gear assembly including a spring assembly for dissipating energy forces imparted to said draft gear assembly and as cast draft gear housing designed to surround said spring assembly, wherein said draft gear housing is formed from an austempered composite metal material having a density of generally about 0.25 lb./cu. in., and wherein said housing includes an open end, a closed end, wall structure axially extending between said ends and an original shape including a predetermined operative length, with said wall structure including a tubular axial section having a generally uniform cross-sectional thickness along a length thereof ranging between about 9.5 inches and about 17.5 inches such that said axial section of said wall structure offers over-solid energy absorption protection for said draft gear assembly and is configured to withstand impact energy in excess of 81,000 inch pounds while retaining and exhibiting substantially linear elasticity wherein the resultant ratio of energy input remains substantially constant, with the original shape and predetermined operative length returning to said casting after the impact energy imparted to said casting is removed therefrom.

11. The railcar draft gear assembly according to claim 10 wherein the operative length of said housing measures between about 14 inches and about 29 inches between said open and closed ends.

12. The railcar draft gear assembly according to claim 10 wherein said housing defines openings arranged toward the closed end of said housing so as to reduce an overall weight of said housing to generally between about 75 lbs. and about 150 lbs.

13. The railcar draft gear assembly according to claim 10 wherein said as-cast draft gear housing is formed from a grade of ductile iron selected from the group consisting of: ASTM Grade 1 ductile iron through ASTM Grade 5 ductile iron.

14. The railcar draft gear assembly according to claim 10 wherein the wall structure of said as-cast draft gear housing, including said axial section, has a generally cylindrical cross-sectional configuration extending between said open and closed ends.

* * * * *